United States Patent [19]

Abendschein et al.

[11] Patent Number: 4,776,136

[45] Date of Patent: Oct. 11, 1988

[54] FIBER OPTIC POLISHING BUSHING

[75] Inventors: Frederic H. Abendschein, Columbia; Paul B. Derr, Middletown; John H. Huber, Harrisburg; Randy M. Manning, New Cumberland, all of Pa.

[73] Assignee: AMP Incorporated, Harrisburg, Pa.

[21] Appl. No.: 65,202

[22] Filed: Jun. 22, 1987

[51] Int. Cl.[4] ..... B24B 41/06

[52] U.S. Cl. ..... 51/216 R; 51/216 P; 51/227 R

[58] Field of Search ..... 51/216 R, 216 LP, 216 P, 51/217 R, 227 R, 283 R, 219 R, 124 R, 124 L, 156; 269/157; 439/314

[56] References Cited

U.S. PATENT DOCUMENTS

| | | | |
|---|---|---|---|
| 3,388,503 | 10/1968 | Uberti | 51/219 R |
| 4,330,965 | 5/1982 | Clark . | |
| 4,384,431 | 5/1983 | Jackson . | |
| 4,445,743 | 5/1984 | Bakker | 439/314 |
| 4,539,776 | 9/1985 | Weaver, Jr. | 51/217 R |
| 4,614,402 | 9/1986 | Caron et al. . | |

OTHER PUBLICATIONS

Photonics Spectra, "Connector Design: Controlling Losses" by T. Bowen and J. Ashman, 2/83, pp. 43–50.

IS 7870, IS 6856, IS 2920, IS 2745, IS 2778, IS 9107.

Data Sheet 81-617-issued 6-81, AMP Optimate SMA Type Fiber Optic Connectors.

Data Sheet 78-513-issued 5-80, AMP Optimate Small Fiber Connector.

Data Sheet 75-337-revised 2-80, AMP Optimate Single Position Fiber Optic Connector.

*Primary Examiner*—Robert P. Olszewski

*Assistant Examiner*—Lawrence Cruz

[57] ABSTRACT

A polishing bushing for polishing the end face of an optical fiber supported within a rigid sleeve includes a bushing base (31, 131) having a front surface (36, 136). The rigid sleeve (21, 21*a*) normally protrudes from beyond the front surface (36, 136) to permit the end face (14, 14*a*) of the optical fiber (12, 12*a*) carried therein to be polished. The bushing includes resilient portion (34) for permitting the rigid sleeve (21, 21*a*) to move longitudinally in passageway (38) to limit the force applied to the end face (14, 14*a*) of the fiber (12, 12*a*) by the polishing medium. The front surface (36, 136) of the bushing base (31, 131) is of spherical shape to produce a polished fiber end face (14) which is convex and which protrudes from the rigid sleeve (21) by less than about one micron, or is of flat shape to consistently produce a polished end face (14*a*) which is recessed within the sleeve (21*a*) by less than about one micron.

17 Claims, 1 Drawing Sheet

FIBER OPTIC POLISHING BUSHING

FIELD OF THE INVENTION

The present invention relates generally to apparatus for polishing optical fibers, and, more particularly, to a polishing bushing for polishing optical fibers in a controlled, repeatable manner.

BACKGROUND OF THE INVENTION

Optical transmission systems frequently includes sections of optical fibers connected end-to-end to transfer light from one fiber to another. In such systems, it is desirable that the transfer of light between fibers be accomplished with little loss of signal; i.e., with low insertion loss. Insertion loss can result from several factors including the presence of a gap or separation between the ends of the connected fibers. Specifically, some light is lost if the end faces of two fibers are separated because light diverges as it radiates from the end of a fiber. In addition, fiber-to-fiber separation results in an insertion loss due to Fresnel reflections at the two glass-air interfaces between the spaced fibers.

Optical fibers are available in multi-mode and single-mode types. Multi-mode fibers have relatively high propagation losses. Because they are inherently lossy, some insertion loss at the interface of two connected multi-mode fibers can often be tolerated.

Single-mode fibers are manufactured such that propagation losses are significantly reduced. In single-mode systems, therefore, insertion losses at the interface of connected fibers must be minimized. In single-mode systems, accordingly, it is particularly important that the end faces of connected fibers be maintained in virtual contact with one another to minimize insertion losses due to fiber-to-fiber separation and Fresnel reflections.

Optical fiber connectors frequently include a rigid sleeve of ceramic or other hard material or a sleeve of resilient plastic, which supports the optical fiber and holds it rigidly in position within the connector. The fiber protrudes slightly from the end of the sleeve when manufactured, and it is necessary to polish the end face of the protruding fiber prior to incorporation of the connector into an optical transmission system.

Typically, the end face of the fiber was polished by mounting the connector to a polishing tool such that the end of the ceramic sleeve extended from a flat end surface of the tool. The tool was then moved over a polishing medium by hand until the end face of the protruding fiber was satisfactorily polished.

With known polishing tools, the polishing process was inconsistent, unpredictable manner. For example, the fibers were often polished to such an extent that the polished ends of the fibers because slightly recessed within the ceramic sleeve in which they were supported. The recesses resulted in a gap between connected fibers which, although often acceptable in multi-mode fiber systems, were unacceptable in single mode systems.

In general, known polishing tools required skilled personnel exercising substantial care to produce acceptably polished fibers.

SUMMARY OF THE INVENTION

The present invention provides a fiber-optic polishing bushing for polishing optical fibers in a controlled, repeatable manner. The polishing bushing is particularly designed for polishing the end face of an optical fiber which is carried within an optical fiber connector of the type which includes a rigid or resilient sleeve within which the optical fiber is supported. The bushing comprises a bushing member having a passageway extending therethrough from a front surface to the back end thereof, and means for mounting the connector to the bushing member with the rigid sleeve extending through the passageway such that an end of the rigid sleeve normally protrudes out of the passageway beyond the front surface of the bushing member to permit the end face of the optical fiber supported therein to be polished by moving the polishing bushing relative to a polishing medium. The mounting means includes resilient means for permitting the rigid sleeve to move longitudinally within the passageway during a polishing operation to limit the force applied to the end face of the optical fiber by the polishing medium during polishing to prevent overpolishing of the optical fiber and, generally, to provide enhanced control over the polishing operation.

In accordance with a preferred embodiment of the invention, the resilient means comprises a relatively weak spring which normally urges the connector forwardly such that the end of the rigid sleeve protrudes out of the passageway beyond the front surface of the bushing member to permit the end face of the optical fiber to be polished. If the force by which the optical fiber is pressed against the polishing medium exceeds the force of the spring at any time during the polishing operation, however, the spring compresses, allowing the rigid sleeve and the optical fiber supported therein to retract into the bushing member. In this way, excessive polishing of the optical fiber is prevented and the optical fiber is polished in a controlled, highly predictable manner.

According to one aspect of the invention, the front surface of the bushing member is of spherical shape and the passageway extends radially into the bushing member from the front spherical surface. The spherical front surface of the bushing member results in the end face of the optical fiber being polished to a convex curved shape which protrudes slightly from the end face of the rigid sleeve within which it is supported. When the curved, protruding end face of the fiber is mated with a similarly polished optical fiber in a complementary connector, the end surface of the mated fibers contact each other and elastically deform under axial load to flatten against each other, so that the mated fibers are in virtual contact with one another over their entire end surfaces, substantially eliminating any gap between the ends of the fibers and minimizing insertion losses therebetween due to fiber-to-fiber separation and Fresnel reflections. Accordingly, the polishing bushing of the present invention can be effectively used to polish optical fibers of the single-mode type.

According to a further aspect of the invention, the front surface of the bushing member comprises a flat surface. The flat bushing member surface results in the end face of the polished fiber being slightly recessed within the rigid sleeve in which it is supported for applications in which a slightly recessed fiber is desired or acceptable.

With the polishing bushing of the present invention, optical fibers can be polished in a predictable, repeatable manner by relatively unskilled personnel. By using a bushing member having a curved end surface, polished optical fibers are consistently produced which have convexly curved end faces which protrude from the end face of the rigid sleeve by less than about one micron. By using a bushing member having a flat end surface, polished optical fibers are consistently produced which are recessed within the rigid sleeve by less than about one micron.

According to yet a further aspect of the invention, the polishing bushing comprises an assembly and the bushing member comprises a bushing base which is removably mountable within the assembly. Either the curved or the flat surfaced bushing base can be incorporated into the bushing assembly permitting the polishing bushing of the invention to be sold as a "kit" containing both bushing bases to provide greater flexibility and convenience to the user.

Further features and specific details of the invention will become apparent hereinfter in conjunction with the following detailed description of a presently preferred embodiment.

DETAILED DESCRIPTION OF THE PREFERRED EMBODIMENT

Figure 1:
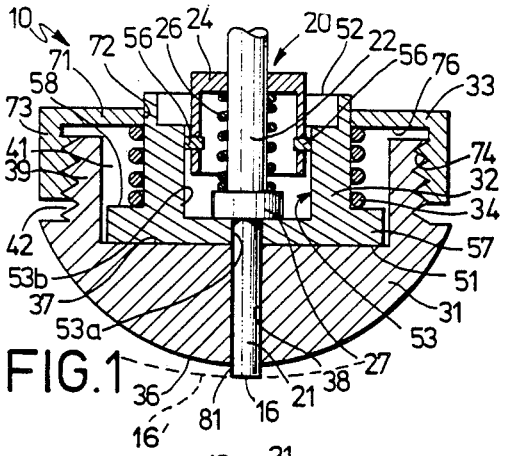
FIG. 1 is a cross-sectional view of a fiber-optic polishing bushing according to a presently preferred embodiment of the invention.
Figure 2:
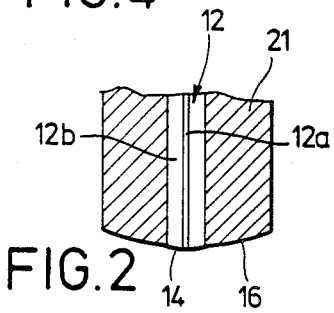
FIG. 2 schematically illustrates the end of an optical fiber connector supporting an optical fiber polished by the polishing bushing of FIG. 1.

FIG. 1 illustrates a fiber-optic polishing bushing according to a presently preferred embodiment of the invention. The polishing bushing is generally designated by reference numeral 10 and is adapted to receive an optical fiber connector 20 which carries an optical fiber 12 having an end face 14 to be polished as shown in FIG. 2.

Optical fiber connector 20 comprises a ceramic connector in which optical fiber 12 extends through and is supported within a rigid ceramic sleeve 21 which protects the fiber and holds it tightly in position within the connector. Connector 20 further includes a connector body 22 from which rigid sleeve 21 extends; a connector nut 24 and a connector spring 26.

Connector nut 24 includes a coupling structure for releasably coupling connector 20 to a complementary optical fiber connector. Bayonet-type couplings are well-known in the art (see, for example, U.S. Pat. Nos. 4,611,213 and 4,445,743) and, thus, are not described in detail herein. The nut is useful with any known type of coupling structure, or with a desired connector that does not require a coupling device assembled on the coupling nut.

When connector 20 is coupled to a complementary connector, end face 14 of optical fiber 12 mates with the end face of an optical fiber in the complementary connector to permit light to be transferred from one fiber to the other. Connector spring 26 is positioned between connector nut 24 and flange 27 on connector body 22, and urges connector body 22 and rigid sleeve 21 forwardly towards the complementary connector to help maintain the fibers in mated condition.

Polishing bushing 10 comprises an assembly which includes a bushing base 31, a bushing body 32, a retainer 33 and a bushing spring 34. Bushing base 31 comprises a rigid member of steel or other suitable material and includes a spherical convex curved, front surface 36, a back surface 37 and a passageway 38 extending therethrough from the front surface to the back surface. Base 31 also includes an annular sidewall portion 39 which extends rearwardly from back surface 37 and defines a cylindrical cavity 41. A portion of the outer surface of sidewall 39 is threaded as illustrated at 42.

Bushing body 32 comprises a generally cylindrical member having a front end 51, a back end 52 and an axial bore 53 extending therethrough from front end 51 to back end 52. Bore 53 includes a front bore portion **53*a* having a diameter substantially equal to passageway 38 in bushing base 31, and an enlarged diameter, bore portion 53*b*. Bushing body 32 is adapted to be positioned in cylindrical cavity 41 of base 31, as shown in FIG. 1, such that bore portion 53*a* of body 32 is in alignment with passageway 38**.

Bushing body 32 includes coupling structure 56 of the bayonet-type for engaging the bayonet coupling structure on connector nut 24 to releasably secure the connector 20 to bushing 10. In the illustrated embodiment, coupling structure 56 comprises a pair of pins or pegs adapted to extend into meandering slots (not shown) on nut 24 as is known in the art. Bushing body 32 further includes an outwardly extending annular flange 57 having a back surface 58 which functions as a first bearing surface for bushing spring 34.

Bushing retainer 33 includes a circular plate portion 71 having an axial opening 72 for receiving bushing body 32, and a forwardly extending flange portion 73 having an internally threaded surface 74 for engaging externally threaded surface 44 on bushing base 31. The front, inner surface 76 of plate portion 71 functions as a second bearing surface for bushing spring 34.

Bushing spring 34 comprises a coil spring and is positioned around bushing body 32. The opposite ends of the spring bear against bearing surfaces 58 and 76 on the bushing body 32 and retainer 33, respectively. As will be explained hereinafter, bushing spring 34 is substantially weaker than connector spring 26 and comprises resilient means for limiting the pressure applied to the end face 14 of optical fiber 12 during a polishing operation.

As best shown in FIG. 2 optical fiber 12 includes a core 12a and a cladding layer **12*b*, and is retained within connector sleeve 21 by a layer of epoxy. The connector is manufactured such that a short length of fiber protrudes from the spherically convex curved end face 16 of sleeve 12. The radius of end face 16 is greater than the radius of face 36**. The protruding portion is typically covered by a bead of epoxy, and it is the end face of the protruding portion of the fiber which is to be polished by the polishing bushing of the invention prior to incorporation of the connector into an optical transmission system.

To assemble polishing bushing 10, bushing body 32 having bushing spring 34 positioned therearound is inserted into cavity 41 of bushing base 31. Bushing retainer 33 is then threaded onto bushing base 31 to secure the components together. When assembled, the ends of bushing spring 34 will press against bearing surfaces 58 and 76 on bearing body 32 and retainer 33, respectively; and urge bearing body 32 forwardly to maintain the front surface 51 of bearing body 32 in contact with and pressed against the rear surface 37 of bushing base 31.

Connector 20 is attached to bushing 10 by inserting the connector into enlarged bore portion 53b of bushing body 32 from the back end thereof, and securing the connector to the bushing via the coupling structure on connector nut 24 and bushing body 32.

When connector 20 is secured within bushing 10, rigid sleeve 21 extends through bore portion 53a in bushing body 32 and passageway 38 in bushing base 31 such that an end portion 81 of the rigid sleeve protrudes slightly beyond the front surface 36 of bushing base 31 as shown in FIG. 1. The end face 14 of optical fiber 12 is then polished by moving bushing 10 over a polishing medium such as a polishing paper 82 illustrated in FIG. 4. As known to those skilled in the art, polishing paper 82 is supported on a rigid plate 84, with a resilient pad 86 normally positioned between paper 82 and plate 84. Bushing 10 is moved over the polishing between paper 82 and plate 84. Bushing 10 is moved over the polishing paper by hand, usually in a figure-eight pattern until the end face 14 of the fiber is polished.

Figure 3:
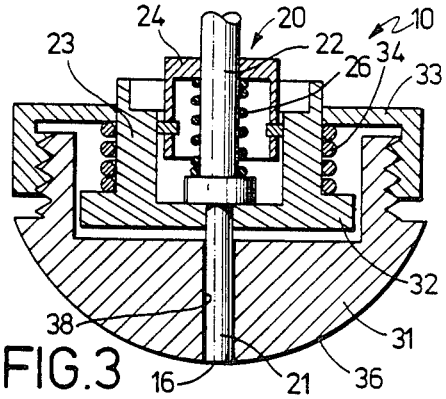
FIGS. 3 and 4 illustrate the operation of the polishing bushing of FIG. 1.

Bushing spring 34 comprises resilient means for permitting rigid sleeve 21 to move longitudinally within passageway 38 of bushing base 31 during a polishing operation to limit the pressure which can be applied against the end face 14 of optical fiber 12 by polishing paper 82 during polishing. In particular, if, at any time during a polishing operation, the force by which the optical fiber is pressed against the polishing paper exceeds the spring strength of bushing spring 34; spring 34 will be compressed permitting connector 20 to move rearwardly in bushing 10 and permitting rigid sleeve 21 to retract into passageway 38 of bushing base 31 to the position shown in FIG. 3. In this way, bushing 10 automatically prevents over-polishing of optical fiber 12 and permits the end face of the fiber to be polished in a highly predictable, repeatable manner.

When the excessive polishing force is relieved, bushing spring 34 automatically expands and pushes connector 20 forwardly such that rigid sleeve 21 again extends beyond front surface 36 of bushing base 31 to permit the end of the optical fiber to be further polished.

Bushing spring 34 is substantially weaker than connector spring 26. Accordingly, when an excessive force is applied during polishing, the connector as a whole moves rearwardly within the bushing, and the connector spring itself does not compress to any significant extent.

Figure 5:
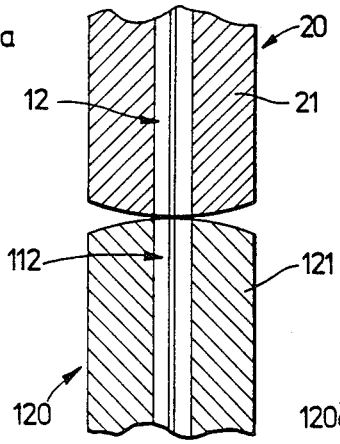
FIG. 5 illustrates the end of the optical fiber connector of FIG. 2 mated with an optical fiber in a complementary optical fiber connector.

As shown in FIG. 1, front surface 36 of bushing base 31 comprises a curved surface, preferably a spherically curved surface; and passageway 38 extends radially into base 31 from surface 36. By polishing optical fiber 12 with a bushing having a curved front surface, end face 14 of the fiber is polished to a convex curvature which protrudes slightly from the end face 16 of rigid sleeve 21 as shown in FIG. 2. Because fiber 12 is convexly curved and protrudes from rigid sleeve 21, when connector 20 is connected to a complementary connector 120 having a similarly polished fiber 112 supported in a rigid sleeve 121, as shown in FIG. 5, the end faces of the mated fibers compress flat and are in virtual contact with one another over their entire end surfaces. Accordingly, there is essentially no gap or separation between mated fibers 12 and 112 thus minimizing insertion losses therebetween due to fiber-to-fiber separation and Fresnel reflections. The polishing bushing of the present invention, therefore, can be effectively used to polish optical fibers of the single-mode or multimode type which require that insertion losses and reflection between connected fibers be minimized.

With the polishing bushing of the present invention, optical fibers can be polished in a consistent, repeatable manner by relatively unskilled personnel. The bushing spring 34 prevents over-polishing of fibers by preventing excessive forces from being applied to their end faces during polishing. In addition, the curved front surface of the bushing base ensures that the end faces of the fibers are always polished to a convex curved shape that protrudes from the end of the rigid sleeve by a consistent distance of less than about one micron.

Figure 4:
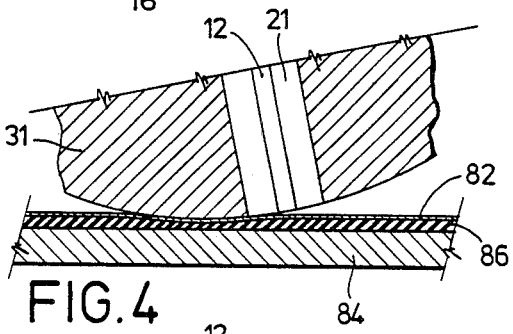

Because of the curved shape of front surface 36 of bushing base 31, the bushing tends to wobble or tilt in a random manner during a polishing operation. If the extent of the wobble becomes excessive at any time during polishing, the end of the fiber will move out of contact with the polishing paper during such periods as shown in FIG. 4, to prevent uneven polishing or damage to the fiber during such periods. With prior polishing bushings having flat surfaces, any wobble of the bushing during polishing often resulted in uneven polishing making it difficult to polish fibers in a consistent, repeatable manner. The polishing bushing surface 36 has a radius of curvature of 17.5 mm or 0.689 inches. The radius of curvature 16', shown in FIG. 1, of the end face 16 of the sleeve 21 is 30 mm or 1.18 inches, and is greater than the radius of curvature of the polishing bushing surface 36. During a polishing operation, the end face of the optical fiber 12 protrudes from the ends face 16 of the sleeve 21. The resilient pad undergoes resilient deflection in response to being compressed by the end face 16 of the ceramic sleeve and the end face of the optical fiber, and conforms to the curvature of the end face 16. Since the polishing paper is flexible and conforms to the surface of the resilient pad, the polishing paper will conform also to the curvature of the end face 16 of the ceramic sleeve which compresses against the polishing paper and against the resilient pad under the polishing paper. The polishing paper also will conform to the curvature of the polishing bushing surface 36, even though of different radius of curvature than that of the ceramic sleeve 21. During the polishing operation, the described random wobble of the polishing bushing accompanying the movement of the end face of the optical fiber against the polishing paper will present constantly changing different portions of the end face against the polishing paper, and cause the paper to polish the end face 16 to a convex curved and nearly spherical bulbous shape with no sharp edges. The polishing paper will polish the surface of the end face 16 of the optical fiber 12 to a different radius of curvature than that of the polishing bushing surface 36, and more like the radius of curvature of the end face 16 of the ceramic sleeve. The bulbous shape of the end face of the optical fiber need not be precisely spherical or have a precise radius of curvature. During mating together of two optical fibers as shown in FIG. 5, the bulbous end faces of two polished optical fibers 12, 112 will press in contact against each other without sharp edges to be fractured, and with the direct contact of the end faces preventing Fresnel reflection and other contributions to attenuation of optical signals transferred between the end faces.

Figure 6:
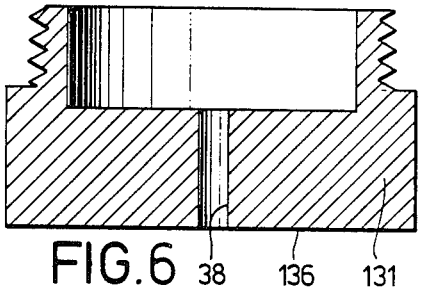
FIG. 6 illustrates an alternative bushing base which may be incorporated into the polishing bushing of FIG. 1.
Figure 8:
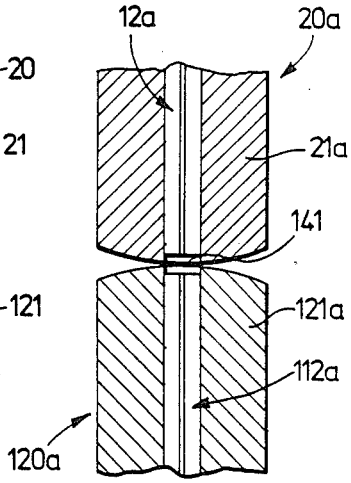
FIG. 8 illustrates the end of the optical fiber connector of FIG. 7 mated with an optical fiber in a complementary optical fiber connector.
Figure 7:
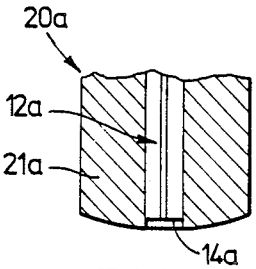
FIG. 7 schematically illustrates the end of an optical fiber connector supporting an optical fiber polished by the polishing bushing of the invention incorporating the bushing base of FIG. 6.

The polishing bushing of the present invention also produces improved results when modified to incorporate a bushing base having a flat front surface as shown in FIG. 6. Bushing base 131 in FIG. 6 is identical to a bushing base 31 except that the front end surface 136 thereof is flat instead of curved. When bushing base 131 is incorporated into bushing 10, a polished optical fiber is produced which is slightly recessed in the rigid sleeve within which it is supported. In particular, FIG. 7 schematically illustrates the end of an optical fiber **12*a* in a rigid sleeve 21*a* of an optical fiber connector 20*a* which has been polished by the polishing bushing of FIG. 1 modified to incorporate bushing base 131. As shown, the end face 14*a* of fiber 12*a* is slightly recessed in sleeve 21*a*. As shown in FIG. 8, when fiber 12*a* is mated with a similarly polished optical fiber 112*a* in a rigid sleeve 121*a* in a complementary connector 120*a*, a slight gap or space 141 exists between the end faces of the mated fibers. Gap 141 results in some insertion loss between the connected fibers due to fiber-to-fiber separation and Fresnel reflections. Bushing base 131**, however, produces polished fibers which are recessed by less than about one micron in a consistent, repeatable manner.

An important feature of the present invention is that bushing bases 31 and 131 are interchangeable within bushing 10. Specifically, bushing 31 in FIG. 1 can be easily removed from bushing 10 by simply unthreading it from bushing retainer 33, and bushing base 131 can then be threaded onto the retainer to provide polishing bushing 10 with a flat front surface. The bushing of the present invention can thus be sold in the form of a "kit" which includes both bushing bases 31 and 131 to provide convenience and flexibility to the user.

While what has been described constitutes presently most preferred embodiments of the invention, it should be understood that the invention can take numerous other forms. For example, although rigid sleeve 21 is referred to herein as a ceramic sleeve, sleeve 21 could also be formed of other suitable hard or soft materials, if desired. In addition, bushing spring 34 can comprise other types of springs rather than the coil spring described herein. Because the invention can take many forms, it should be recognized that the invention should be limited only insofar as is required by the scope of the following claims.

We claim:

1. A polishing bushing for polishing the end face of an optical fiber, said optical fiber being carried within optical fiber support structure which includes a rigid sleeve for supporting the optical fiber and a first resilient member for normally urging the rigid sleeve forwardly within the optical fiber support structure, said polishing bushing comprising:

first bushing structure including a bushing body for supporting said optical fiber support structure;

second bushing structure for receiving said first bushing structure, said second bushing structure including a bushing base having a front surface and a passageway extending thereinto from said front surface, said passageway being aligned with said rigid sleeve such that said rigid sleeve extends into said passageway; and a second resilient member for normally urging said first bushing structure and said optical fiber support structure supported thereby forwardly in said second bushing structure such that said rigid sleeve normally protrudes out of said passageway in said bushing base beyond said front surface to permit the end face of said optical fiber supported therein to be polished by moving the polishing bushing relative to a polishing medium, said second resilient member permitting said first bushing structure and said optical fiber support structure supported thereby to move rearwardly in said second bushing structure for permitting said rigid sleeve to retract into said passageway during periods of a polishing operation when the force by which the bushing is pressed against said polishing medium exceeds the strength of said second resilient member to prevent overpolishing of said optical fiber and, generally, to provide enhanced control over the polishing operation.

2. The polishing bushing of claim 1 wherein said front surface of said bushing base comprises a curved surface.

3. The polishing bushing of claim 2 wherein said curved surface comprises a spherical surface, and wherein said passageway extends radially into said bushing base from said spherical surface.

4. The polishing bushing of claim 1 wherein said front surface of said bushing base comprises a flat surface.

5. The polishing bushing of claim 1 wherein said second resilient member is weaker than said first resilient member whereby said optical fiber support structure as a whole moves rearwardly in said second bushing structure when the force by which the bushing is pressed against the polishing medium exceeds the strength of said second resilient member.

6. The polishing bushing of claim 5 wherein said second resilient member comprises a bushing spring.

7. The polishing bushing of claim 6 wherein said second bushing structure further includes a bushing nut mounted to said bushing base, and wherein said bushing body includes an outwardly extending annular flange thereon, said bushing spring being supported between said outwardly extending annular flange of said bushing body and said bushing nut for normally urging said bushing body forwardly in said second bushing structure.

8. The polishing bushing of claim 1 and further including coupling means for releasably attaching said optical fiber support structure to said bushing body.

9. The polishing bushing of claim 8 wherein said coupling means comprises bayonet-type coupling structure on said bushing body for engaging bayonet-type coupling structure on said optical fiber support structure.

10. The polishing bushing of claim 1 wherein said optical fiber support structure comprises an optical fiber connector, and wherein said first resilient member comprises a connector spring which is normally adapted to urge said rigid sleeve forwardly in the connector to help maintain said optical fiber mated with an optical fiber in a complementary connector when said connector is mated with a complementary connector.

11. A polishing bushing for polishing the end face of an optical fiber, said optical fiber being carried within an optical fiber connector which includes a rigid sleeve for supporting the optical fiber, and a connector spring for normally urging the rigid sleeve forwardly in the connector to help maintain the optical fiber mated with an optical fiber in a complementary connector when the connector is mated with a complementary connector, said polishing bushing comprising:

first bushing structure including a bushing body for supporting said optical fiber connector, said bushing body including coupling means for releasably attaching said connector to said bushing body;

second bushing structure for receiving said first bushing structure, said second bushing structure including a bushing base having a front surface and a passageway extending thereinto from said front surface, said passageway being aligned with said rigid sleeve such that said rigid sleeve extends into said passageway; and a bushing spring between said first and second bushing structures for normally urging said first bushing structure and said optical fiber connector supported thereby forwardly in said second bushing structure such that said rigid sleeve normally protrudes out of said passageway in said bushing base beyond said front surface to permit the end face of said optical fiber supported therein to be polished by moving the polishing bushing relative to a polishing medium, said bushing spring being weaker than said connector spring for permitting said first bushing structure and said optical fiber connector supported thereby to move rearwardly in said second bushing structure for permitting said rigid sleeve to retract into said passageway during periods of a polishing operation when the force by which the bushing is pressed against said polishing medium exceeds the strength of said bushing spring to prevent overpolishing of said optical fiber and, generally, to provide enhanced control over the polishing operation.

12. The polishing bushing of claim 11 wherein said front surface of said bushing base comprises a spherical surface, and wherein said passageway extends radially into said bushing base from said spherical surface for providing a polished end face on said optical fiber which is convexly curved and which protrudes from the end of said rigid sleeve by about one micron.

13. The polishing bushing of claim 11 wherein said front surface of said bushing base comprises a flat surface for providing a polished end face on said optical fiber which is recessed within said rigid sleeve by about one micron.

14. The polishing bushing of claim 11 wherein said second bushing structure further includes a bushing nut, and means for removably mounting said bushing base to said bushing nut.

15. The polishing bushing of claim 14 wherein said bushing body includes an outwardly extending annular flange, and wherein said bushing spring is positioned between said flange of said bushing body and said bushing nut of said second bushing structure for normally urging said bushing body forwardly in said second bushing structure.

16. The polishing bushing of claim 11 wherein said coupling means includes bayonet-coupling structure on said bushing body for cooperating with bayonet-coupling structure on said optical fiber connector for releasably attaching said optical fiber connector to said bushing body.

17. A polishing bushing kit for polishing the end faces of optical fibers, said optical fibers being carried within optical fiber support structures which include rigid sleeves within which the optical fibers are supported, said bushing kit comprising:

first bushing structure including a bushing body which is adapted to support an optical fiber support structure;

second bushing structure for receiving said first bushing structure, said second bushing structure including a first bushing base having a spherical front surface and a passageway extending radially thereinto from the spherical front surface, a second bushing base having a flat front surface and a passageway extending thereinto from the flat front surface, and a bushing nut, said bushing nut including means for selectively removably mounting either said first bushing base or said second bushing base thereto; and a bushing spring for urging said first bushing structure and an optical fiber support structure supported thereby forwardly in said second bushing structure such that the rigid sleeve normally protrudes out of the passageway in the selected bushing base beyond the front surface thereof to permit the end face of an optical fiber supported therein to be polished by moving the polishing bushing relative to a polishing medium, the bushing spring permitting the first bushing structure and the optical fiber support structure carried thereby to move rearwardly in the second bushing structure for permitting the rigid sleeve to retract into the passageway of the selected bushing base during periods of a polishing operation when the force by which the bushing is pressed against the polishing medium exceeds the strength of the bushing spring to prevent overpolishing of the optical fiber and, generally, to provide enhanced control over the polishing operation.

* * * * *